United States Patent [19]

Hunt

[11] 3,994,053

[45] Nov. 30, 1976

[54] DRUM SUPPORT APPARATUS

[75] Inventor: William R. Hunt, Penfield, N.Y.

[73] Assignee: Xerox Corporation, Stamford, Conn.

[22] Filed: Jan. 8, 1976

[21] Appl. No.: 647,398

[52] U.S. Cl. ..... 29/123

[51] Int. Cl.[2] ..... B21B 31/08

[58] Field of Search..... 29/123, 115, 117, 116 R; 355/18; 242/68.6; 101/375

[56] References Cited

UNITED STATES PATENTS

| | | | |
|---|---|---|---|
| 2,020,219 | 11/1935 | Sirianni | 29/117 X |
| 2,583,889 | 1/1952 | Schoonenberg | 29/117 X |
| 2,881,907 | 4/1959 | Pape et al. | 29/123 X |
| 3,481,017 | 12/1969 | Hunt | 29/123 |
| 3,775,008 | 11/1973 | Schaeffer et al. | 355/18 |

*Primary Examiner*—Alfred R. Guest

*Attorney, Agent, or Firm*—James J. Ralabate; Clarence A. Green; William A. Henry, II

[57] ABSTRACT

A drum support apparatus including outboard and inboard hubs having outer surfaces adapted for interface fitting with the inside surface of a drum. The hubs while being supported on a shaft that is cantilevered from a frame, provide support for the drum in the form of a plurality of spaced equidistant lobes located on their outer surfaces. The lobes reduce the load required to properly seat the drum against the hubs and thereby decreases the possibility of drum run-out by reducing the contact area when the interface fit of the drum/hub combination occurs. The shaft is supported at its outboard end by a removable support bracket.

13 Claims, 2 Drawing Figures

DRUM SUPPORT APPARATUS

BACKGROUND OF THE INVENTION

This invention relates to drum support apparatus and more particularly to supports for photosensitive drums that prevent drum run-out.

In present reproduction machines, a problem has been encountered with photoreceptor drum radial run-out of up to 0.050 inches or more. The reason for such a deviation in tolerance lies with the drums and how they are handled in manufacturing and in the field. Hitting the rim of the drum deforms the counterbore, and an out-of-tolerance condition occurs when endbells that interference fit with the drum are reassembled in the drum. This is especially true of the inner endbell in a number of reproduction machines which is concave by about 5 inches. A slight cock in its assembly throws its shaft support bearing off center considerably due to magnification of the error by the length of the concavity. Since in a number of reproduction machines a shaft that is journaled to the machine frame is cantilevered from the frame to support a photoconductive drum without an an exterior support, more runout is observed on the inboard side of the photoconductive drum than on the outboard side.

A solution to the above-mentioned problem of drum run-out is required before improved reproduction machines can be marketed incorporating magnetic brush rollers in their development process instead of cascade development because reducing the radial drum run-out minimizes the effects of the drum tolerances on the spacing between the drum and the magnetic brush rollers.

Accordingly, it is an object of the present invention to provide a drum support apparatus that reduces drum run-out.

Another object of this invention is to reduce copier maintenance in the field.

Yet another object of this invention is to reduce the load required to properly seat the hub against the drum and thereby decrease the possibility of incurring drum run-out.

SUMMARY OF THE INVENTION

In a drum support apparatus including outboard and inboard endbells that are connected by tie rods and adapted to be placed on a cantilevered shaft for supporting a drum, an improvement is disclosed comprising a series of spaced equidistant lobes on the outer surface of the outboard and inboard endbells that are to be fitted on the inner surface of the drum for reducing the contact area when the interface fit between the hub and drum occurs. A two pronged removable support is disclosed for giving rigid support to the cantilevered shaft.

BRIEF DESCRIPTION OF THE DRAWINGS

For a better understanding of the invention as well as other objects and further features thereof, reference is had to the following detailed description of the invention to be used in conjunction with the accompanying drawings, wherein.

DESCRIPTION OF THE PREFERRED EMBODIMENT

The present invention can be used in any device that requires support for a drum. However, for the purpose of exemplary disclosure, the invention will be described within the environment of a xerographic reproduction apparatus. An example of such a xerographic reproduction apparatus is shown in U.S. Pat. No. 3,775,008 in the name of R. A. Schaeffer and is incorporated herein by reference. Examples of prior drum support members include U.S. Pat. Nos. 2,089,401; 3,536,485; 3,615,063; and 3,739,722. It is generally recognized that photoreceptor drum run-out is a significant contributor to field maintenance problems, and that it degrades copy quality.

The photoreceptor drum is the heart of a xerographic copier. As each copy is reproduced, a bar of light scans the original document, and then transmits its reflective image through lenses to a revolving selenium coated drum which has been statically charged. Because of the conductivity of the drum, the light discharges the electrical charges, leaving a latent image identical to that on the document. The drum then rotates through a chamber of powdered ink which coats the charged areas. A sheet of paper is then precisely applied over the image. The image is then transferred electrically to the paper. After transfer the paper is stripped from the drum and passed through a fuser which fixes the image to the paper. To accomplish this, the drum must be (A) discharged, (B) cleaned, (C) charged, (D) exposed, (E) developed, (F) covered with paper and (G) stripped of the paper and image for each copy made. To achieve and maintain reliably good copy quality, the radial dimensions and electrical tolerances in the cavity between the drum and the stations A through G must be rigidly maintained. Any out of roundness or imperfections in the drum surface may result in copy quality variations or possible drum damage, due to interference.

One of the most prevalent methods of bringing the powdered ink or developer material into contact with an image bearing photoconductor is to pour or cascade developer material over the photoconductor, permitting the material to gravity flow downwardly in contact with the photoconductor for a sufficient period of time to affect development. With this method of development, it is satisfactory to support the photoconductive drum on a cantilevered support. However, in order for xerographic machines to use magnetic brush development where the developer material is transported through a development zone adjacent the imaged photoconductor by the magnetic brushes, radial drum run-out or "walking" of the drum must be controlled because spacing between the drum and magnetic brush rollers must be maintained within allowable tolerances or degrading copy quality will result. It is to curtail the "walking" of the drum along the cantilevered shaft that the two pronged end support is disclosed.

Figure 1:
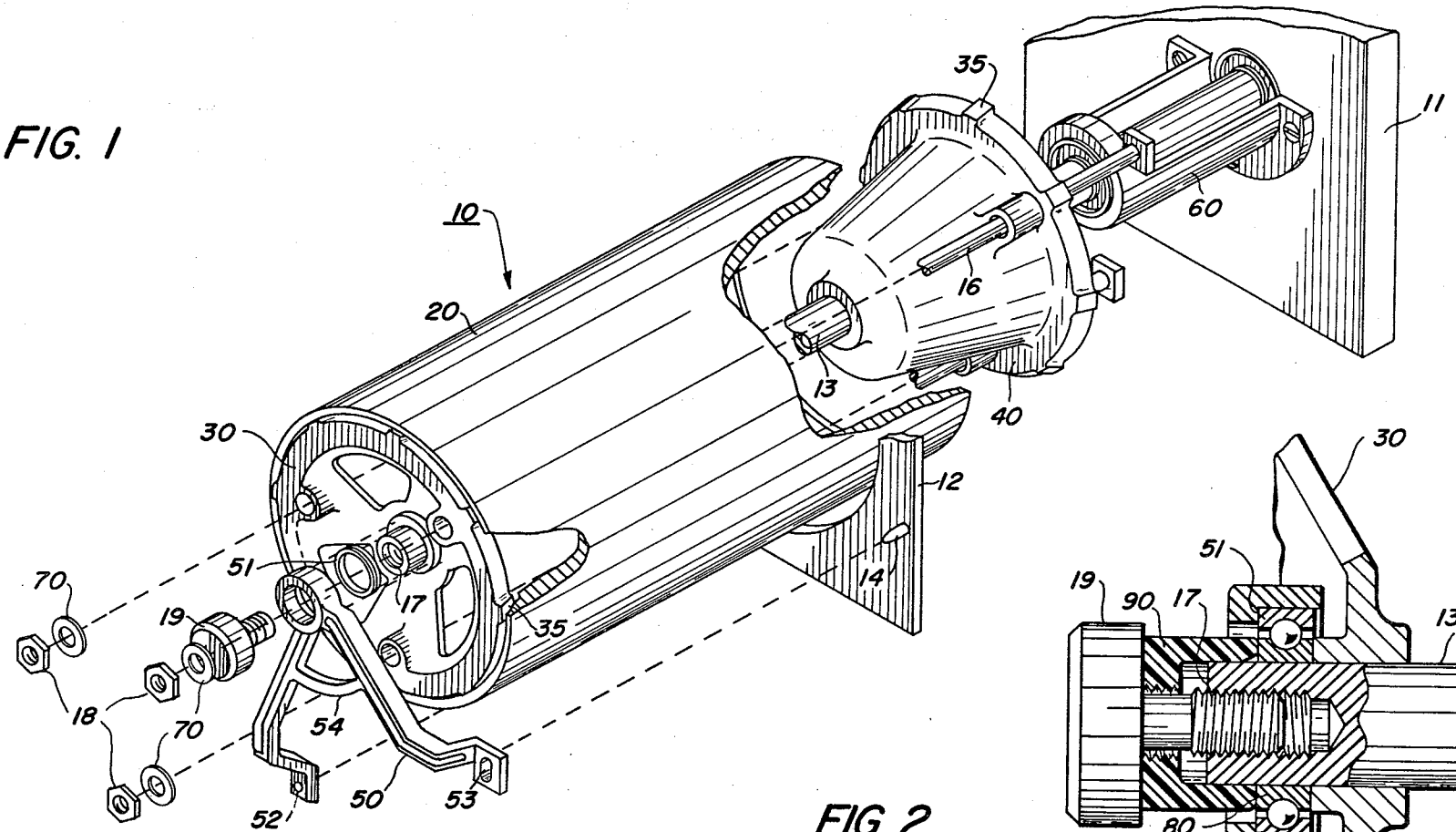
FIG. 1 is an exploded partial schematic of an apparatus incorporating the present invention.

In reference to FIG. 1, the present invention is shown incorporated into a reproduction machine similar to the Xerox 4000. As shown in the Figure, a frame with a front panel 12 and a rear panel 11 for a reproduction machine is shown supporting a shaft 13 that is cantilevery mounted to the frame. Concaved endbells 30 and 40 are shown being supported on the shaft with the rear or inboard endbells 40 having a pronounced cavity thereon that fits over bearing 60. Means are located on the surface of the outboard and inboard endbells immediately adjacent the inner surface of the drum for reducing the contact area where interface fit between the hub and the drum occurs to diminish photoreceptor drum run-out. A photosensitive member 20 is shown as being placeable over the inboard endbell or hub 40 and the front or outboard endbell 30 is shown as being adaptable to close the open end of the drum. Tie rods 16 extend through the openings in the inboard hub or endbells 40 through the interior of the drum and through the complementary openings in the outboard hub and have threads thereon that allow nuts 18 and washers 70 to tighten the inboard and outboard endbells to the drum. A two prong support 50 is also shown adjacent to the outboard hub and is used to stabilize the cantilevered shaft 13 once the drum is placed thereon. End cap 19 connects rotation of the support shaft to the drum through bearing 17.

It is within the area of the endbells and the end support that the present invention resides. There is shown in the Figure, a series of discretely spaced equidistant lobes 35 upon the mounting surface of the inboard hub as well as the outboard hub. The plurality of lobes as they are incorporated into the endbells of the present invention reduce the load required to properly seat the hub against the drum to a preferred torque range of 35 to 55 inch/pounds, although a range of 25 to 75 inch-/pounds would be satisfactory, and thereby reduces run-out and improves drum assembly and disassembly by diminishing the tapered contact surfaces between the drum and the endbells to nine equidistant half-inch wide lobes. While nine lobes are disclosed as preferable for the practice of this invention, it should be understood that a range of 6 to 9 lobes will perform satisfactorily. One of the other objects of reducing the contact surfaces is to reduce assembly interference. Hitting the rim of the drum during assembly, deforms the counterbore and therefore causes an out of tolerance condition to occur. This in turn increases the probability of run-out due to endbells cocking or bending at assembly. Even though the lobes could be made flat as a mating service for the interior end surfaces of the drum, it is preferred that a gradual incline or slope toward the center of the drum be included at the lead edge of each lobe to improve seating or mating of the drum and hubs and possibly reduce deburring time. If one desires to add a heater to the drum the front hub can be redesigned to accommodate a slip ring for such purpose.

A further means of reducing drum run-out is the two pronged support 50 that is releasably mounted on capless pins 14 that are tapered for ease of attachment and detachment of the support to the exterior of front frame panel 12. Maintaining the support in this manner also reduces the time necessary for removal and replacement of drums. This support is in the form of a removable support bracket with two sustantially spaced arms at approximately 90° and a central self-aligning ball bearing bracket support member 51 for the outboard end of the drum shaft. The arms extend a greater distance from the drum support than the radius of the drum and provide a rigid two point mounting support for the unsupported end of the drum shaft. The arms are arcuate in shape to allow connection bearing 17 to be recessed in relation to a vertical plane at the outboard end of the drum. A cross-brace is located at 54 intermediately of the arms to provide reinforcement for the support bracket, as well as serves as a hand grip to assist in installing and removing the bracket. The support bracket has apertures 52 and 53 with aperture 53 being vertically elongated to allow for manufacturing error in placing pins 14 on the front frame panel. Member 53 could be in the form of a vertical dot if one desired. The bracket 50 in addition to the cantilevered support of drum supporting shaft 13 gives three point support to the shaft.

Figure 2:
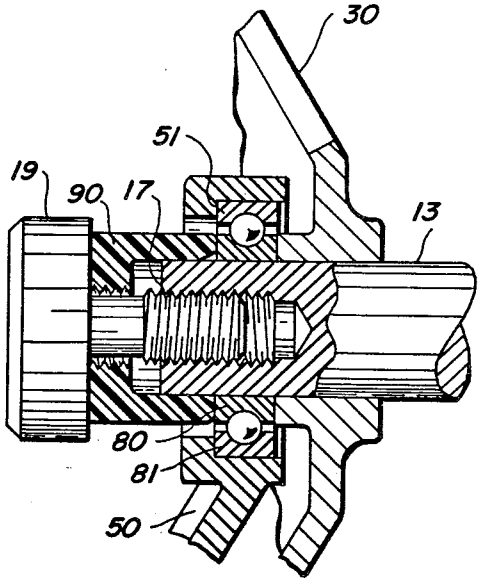
FIG. 2 is an enlarged partial cross-section of a second embodiment of this invention.

In a second embodiment of the present invention shown in FIG. 2 in partial cross-section drum shaft 13 is shown with front hub 30 mounted thereon. A self-aligning ball bearing 51 having an inner race 80 and an outer race 81 is mounted on the drum shaft adjacent to the hub with front end support bracket 50 being supported by the bearing. Floating collar 90 ensures that the clamping force exerted by knob 19 is directed at the face of the inner race 80 of self-aligning bearing 51 and not through the outer race 81. It is because of the possibly poor alignment of the threaded knob in its thread that collar 90 is allowed to float on the knob and seek its own alignment into the outside surface of the drum shaft and onto the face of the inner race of the bearing. If a cap were allowed to load a collar against the outer race and inner race of the bearing the self-aligning feature of the bearing would be somewhat negated. This possible negation is removed in the present invention by means 90 being allowed to float and seek the inner race of the bearing along the outer surface of the drum shaft.

In present reproduction machines, drum mounting hubs provide for an interference fit between the mounting surfaces of the drum and the hub. Improper assembly of these items allows drum run-out to exceed levels compatible with proper machine operation resulting in scratched drums and copy quality problems. As can be seen from the above detailed description, the apparatus of the present invention reduces the contact area where the interference fit occurs. This is accomplished by machining pads on the hub. These pads of which nine are recommended symmetrically spaced even though other numbers of pads could be picked, locate the center of the hub/drum combination as does current systems. The main advantage is to reduce the load required to properly seat the hub against the drum, thereby decreasing the possibility of incurring drum run-out.

In addition to the apparatus outlined above, many other modifications and/or additions to this invention will be readily apparent to those skilled in the art upon reading this disclosure, and these are intended to be encompassed within the invention disclosed and claimed herein.

What is claimed is:

1. In a xerographic apparatus having a frame for supporting said apparatus and including a photosensitive drum, a cantilevered drum mounting shaft extending from said frame, front and rear mounting hubs spaced on said shaft for supporting said drum and tie-rods for connecting said front and rear hubs to said drum, the improvement comprising:

a removable support bracket having two substantially spaced arms for supporting the front end of the drum mounting shaft whereby three point rigid support is provided for said drum mounting shaft.

2. The improvement of claim 1 wherein said arms are approximately 90° apart.

3. The improvement of claim 2 wherein said arms extend from the drum mounting shaft a greater distance than the radius of the drum.

4. The improvement of claim 3 including a self-aligning central ball bearing for supporting said bracket.

5. The improvement of claim 4 including a cross-brace connecting said arms to provide reinforcement for said support bracket.

6. The improvement of claim 5 wherein said cross-brace is located intermediate of said arms.

7. The improvement of claim 1 including two uncapped cantilevered pins that extend from the surface of a front frame panel for supporting said bracket.

8. The apparatus of claim 7 wherein said pins have tapered ends.

9. The apparatus of claim 8 including mounting apertures in said support bracket with at least one of said apertures being elongated.

10. The apparatus of claim 9 wherein said arms are arcuate in shape to allow a connection bearing in the mounting shaft to be recessed in relation to a vertical plane at the outboard end of the drum.

11. The apparatus of claim 10 wherein said hubs are concaved.

12. The apparatus of claim 4 wherein said bearing support member includes an inner race and an outer race.

13. The apparatus of claim 12 including a floating collar adapted to engage said inner race of said bearing support member whereby self-alignment of said outer race in relation to said support bracket is obtained.

* * * * *